United States Patent [19]

Goodhart

[11] Patent Number: 4,646,836

[45] Date of Patent: Mar. 3, 1987

[54] TERTIARY RECOVERY METHOD USING INVERTED DEVIATED HOLES

[75] Inventor: Milton E. Goodhart, Houston, Tex.

[73] Assignee: Hydril Company, Los Angeles, Calif.

[21] Appl. No.: 684,247

[22] Filed: Dec. 20, 1984

Related U.S. Application Data

[63] Continuation-in-part of Ser. No. 637,396, Aug. 3, 1984, Pat. No. 4,605,076.

[51] Int. Cl.[4] ..... E21B 43/24

[52] U.S. Cl. ..... 166/303; 166/50; 166/272; 166/306; 175/61

[58] Field of Search ..... 166/50, 57, 248, 272, 166/302, 303, 306; 175/61

[56] References Cited

U.S. PATENT DOCUMENTS

| | | | |
|---|---|---|---|
| 2,404,341 | 7/1946 | Zublin | 166/50 |
| 2,857,002 | 10/1958 | Pevere et al. | 166/303 |
| 3,386,508 | 6/1968 | Bielstein et al. | 166/303 X |
| 3,441,083 | 4/1969 | Fitzgerald | 166/272 X |
| 4,022,279 | 5/1977 | Driver | 166/306 X |
| 4,066,137 | 1/1978 | Frankle et al. | 175/51 X |
| 4,402,551 | 9/1983 | Wood et al. | 166/50 |

*Primary Examiner*—Stephen J. Novosad
*Assistant Examiner*—Michael A. Goodwin
*Attorney, Agent, or Firm*—Dodge, Bush & Moseley

[57] ABSTRACT

A method for enhanced oil recovery from a subsurface earth formation is disclosed. At least one essentially upward deviated hole from a vertical shaft in the formation is formed. An outer loop borehole is formed in proximity with the deviated hole. A heating fluid is injected from the surface to the outer loop borehole to heat the formation in proximity with the upward deviated hole to facilitate drainage of oil and the like.

7 Claims, 20 Drawing Figures

FIG. 1
(PRIOR ART)
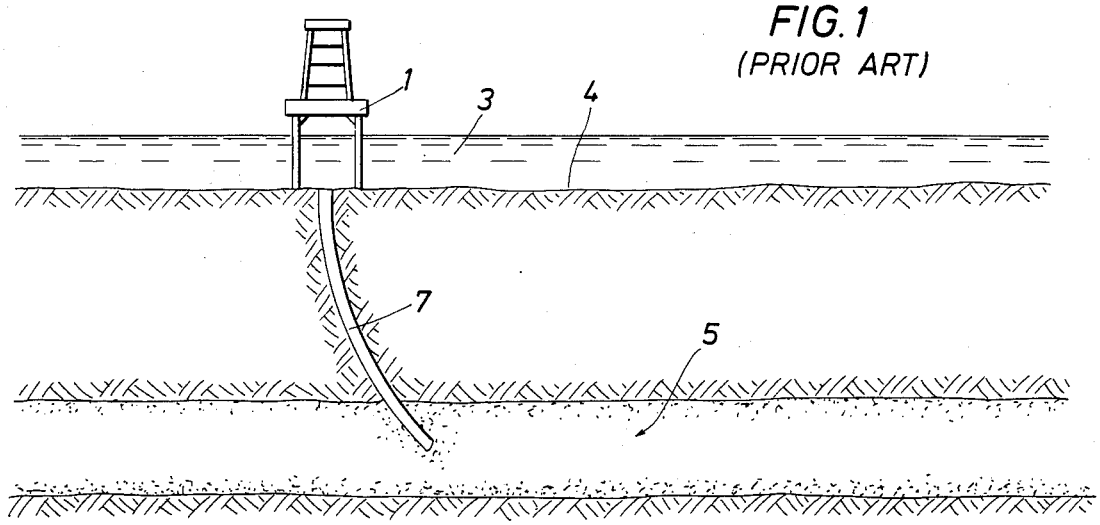
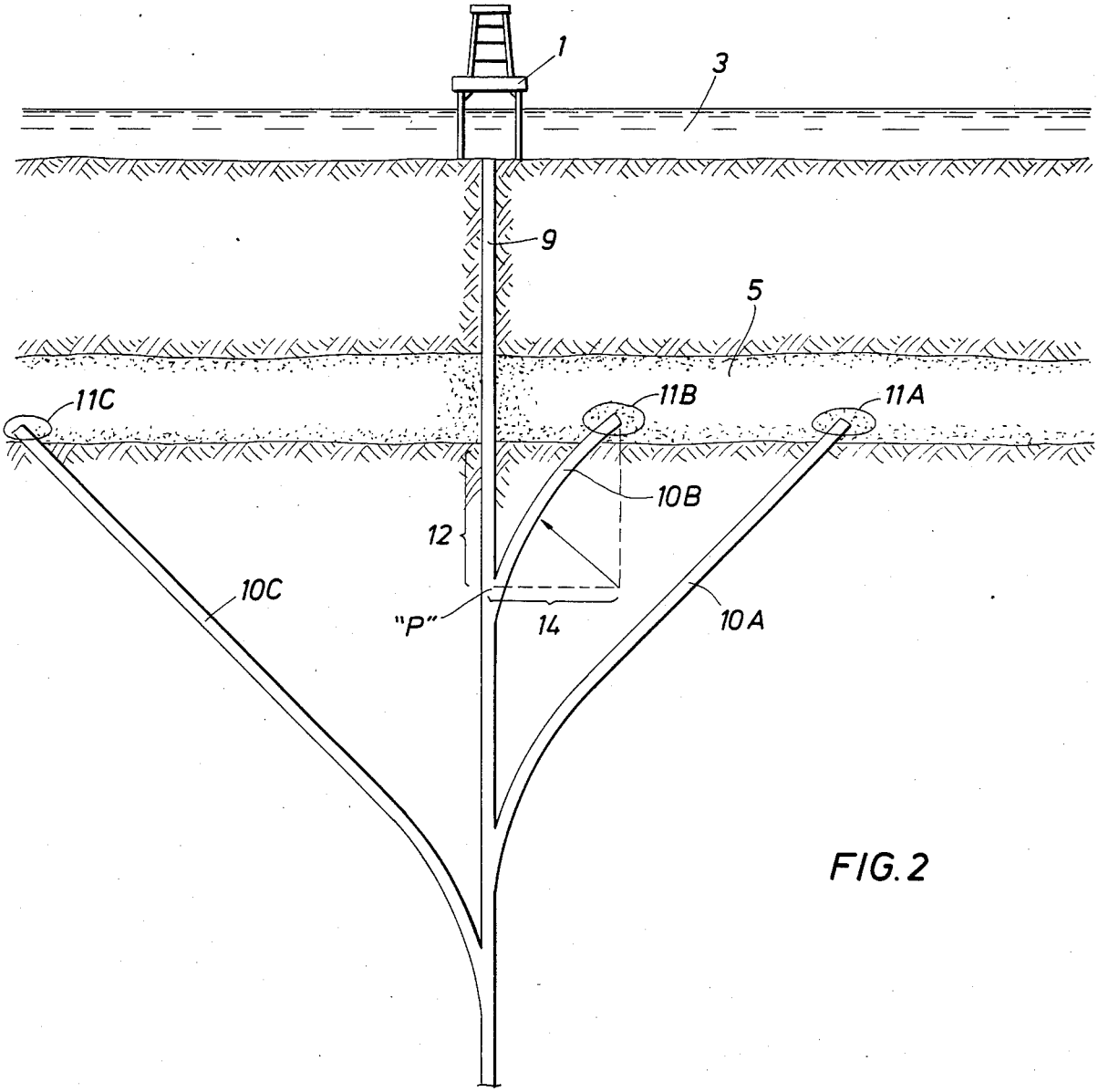
FIG. 2

FIG. 5A
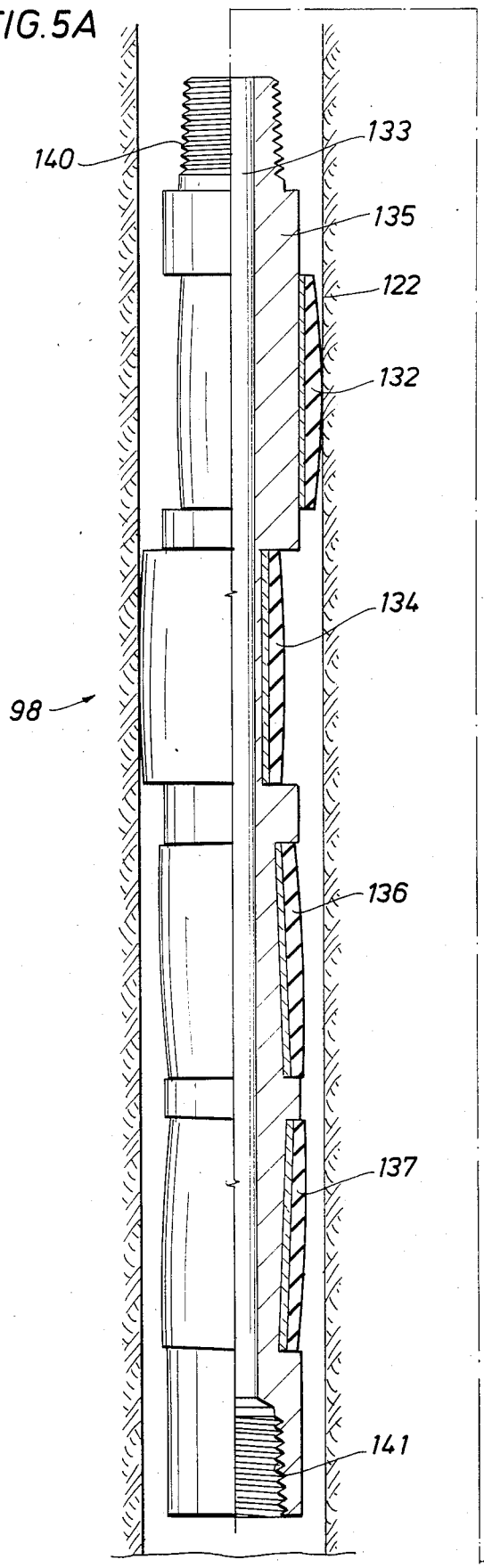
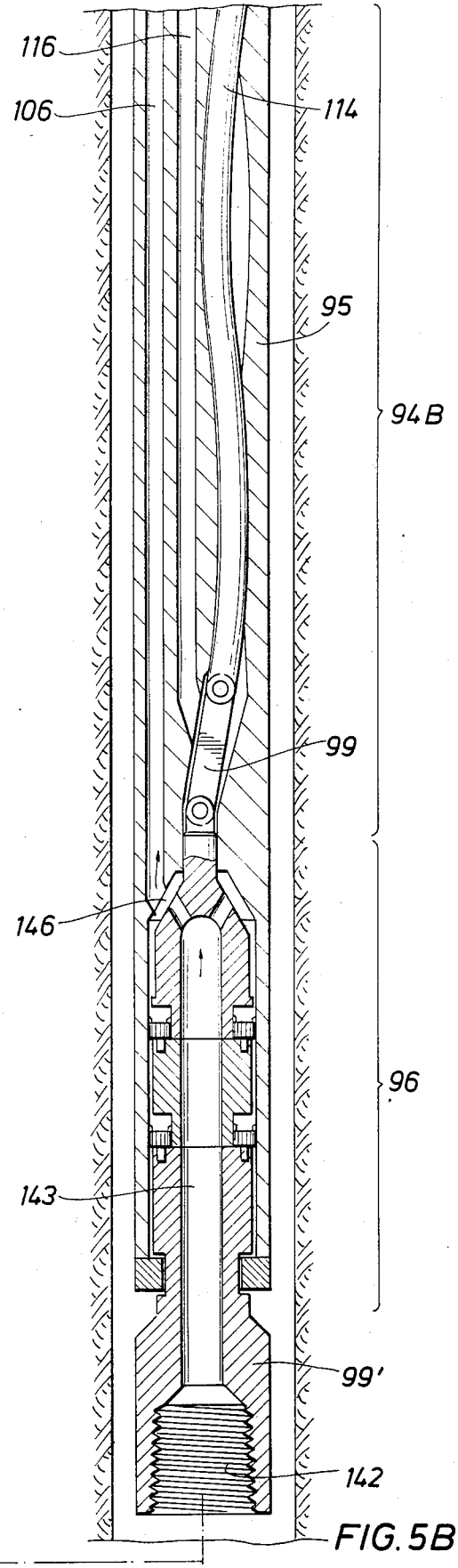
FIG. 5B

FIG.8
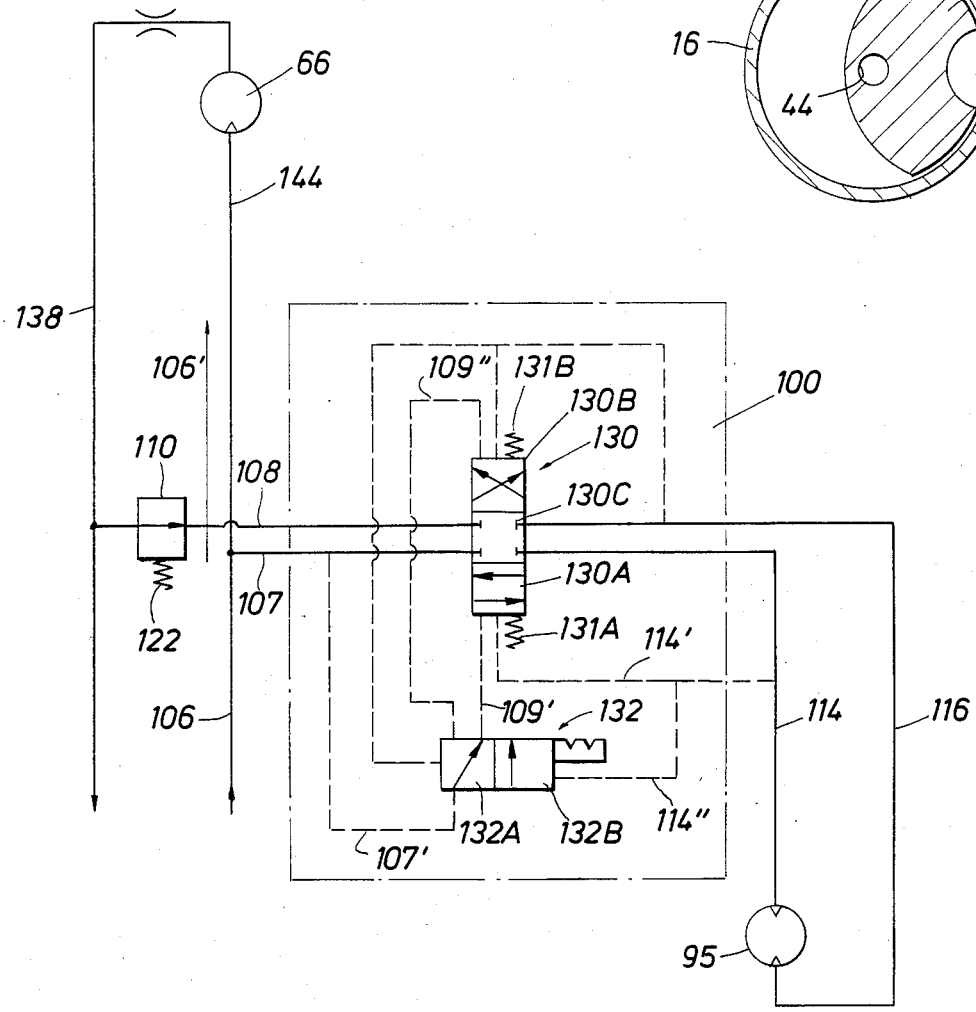
FIG.11
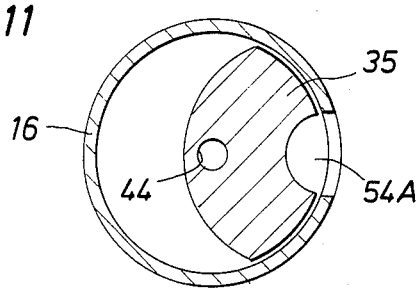
FIG.9
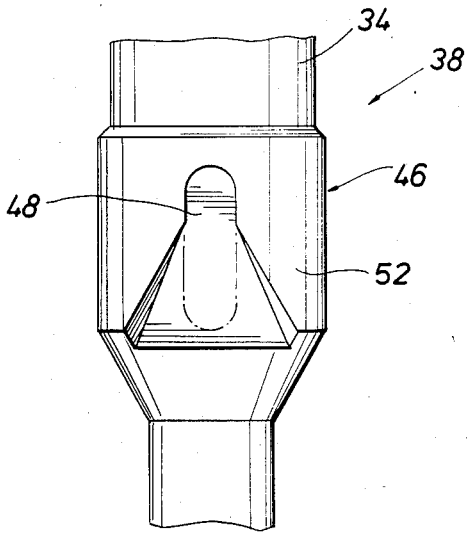
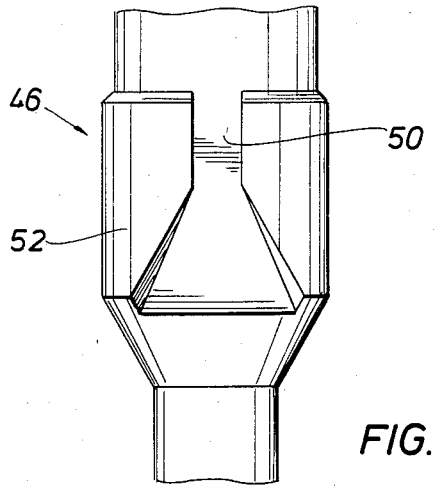
FIG.10

TERTIARY RECOVERY METHOD USING INVERTED DEVIATED HOLES

CROSS REFERENCE TO A RELATED APPLICATION

This application is a continuation-in-part of U.S. application Ser. No. 637,396, filed on Aug. 3, 1984 now U.S. Pat. No. 4,605,076.

BACKGROUND OF THE INVENTION

1. Field of the Invention

This invention relates in general to a method and apparatus for forming well holes. More particularly the invention relates to a method and apparatus for drilling directional boreholes. Still more particularly, the invention relates to forming multiple deviated branch holes from a single location either from an offshore platform or from a single land based rig, into multiple horizontal locations of a pay zone. The invention also provides a method for enhancing the recovery from a hydrocarbon or mineral bearing subsurface formation.

2. Description of the Prior Art

Standard practice for producing offshore oil and gas fields calls for drilling multiple wells from a single platform. The multiple wells are deviated out into the pay zone in order to economiccally develop the field. The standard practice on land is to drill multiple wells into the reservoir and only in unusual situations does it become economically desirable to drill multiple deviated holes out into the formation from a single site. In either case, maximizing the effectiveness of each platform or rig is desirable. In those instances where it is desirable to drill multiple holes from a single site, the production of the field is accomplished by means of directional drilling whereby the drill bit is deflected up to the maximum rate attainable in order to achieve the broadest possible dispersion into the pay zone.

Such deviation allows the wells to fan out from a central location covering a large area of the field, and maximum production is achieved from a single site. However with a shallow pay zone, the directional wells enter the pay zone before achieving sufficient horizontal distance from the platform or rig. The inability to deviate the well sufficiently horizontally because of the shallowness of the pay zone reduces the area coverage from a single site causing many shallow oil and gas fields to be uneconomical to produce, especially in offshore waters where drilling costs substantially exceed land operations.

Another consideration is tight formations or formations which hold high viscosity crudes and require much closer well spacings in order to drain the field. In such cases, if deviated branch holes can be drilled from a single vertical hole, the productivity of each drill site can be increased by permitting better penetration of the target zone. This reduces the number of vertical holes required while at the same time increasing the productivity of the formation into a single well bore.

The prior art has many references to drilling of multiple branch wells from a common vertical well. For example, U.S. Pat. No. 4,396,075 to Wood, et al, illustrates the drilling of a plurality of wells from a vertical shaft by deviating each of the branch wells from the vertical shaft primarily by means of a whip stock drilling guide. U.S. Pat. No. 4,415,205 to Tehm, et al, is another example of producing deviated wells from a central shaft and illustrates the use of a casing which has an internal indexing dog in specific areas which provides "windows" from which some of the branch wells are to be drilled. U.S. Pat. No. 4,402,551, issued in the name of Wood, illustrates the use of a vertical shaft from which a horizontal drain hole is drilled below the cased vertical hole. Likewise, U.s. Pat. No. 4,432,423, issued in the name of Lyons, shows a method and apparatus for drilling a horizontal hole into a producing formation from a vertical shaft.

U.S. Pat. No. 4,431,069 to Dickinson, et al, illustrates a method and apparatus for performing and using a borehole in which a vertical shaft is first produced. A horizontal shaft extends from the vertical shaft and from the horizontal shaft the borehole turns upwardly. Drilling fluid comprising hot acid or basic aqueous or petroleum base solution is used in the drilling process with the aid of an eversible tube. U.S. Pat. No. 2,404,341, issued in the name of Zublin, illustrates a method of producing oil and gas through a deviated bore in which multiple bore holes extend from an initial vertical shaft. The multiple bore holes are illustrated as extending generally outwardly, first downwardly, then upwardly, into a pay zone or hydrocarbon bearing formation. Each of the drilling methods and apparatus disclosed in the references mentioned above have difficulty in reaching sufficiently horizontally from the vertical shaft, especially for shallow formations. For example, one obvious difficulty of drilling a horizontal well from a vertical shaft into a pay zone is to obtain sufficient axial force on a drilling bit in order to drill the horizontal length of hole. Such difficulty is obviously encountered with the use of conventional drilling equipment where the drilling bit is rotated by coupling it to a rotating drill string and is dependent on the limited deviation capability of the string.

The prior art also contains many methods for drilling downward and outward from a vertical bore to achieve increased production such as, by way of example, drain hole drilling. The "drainholes" (holes that turn at right angles to the initial hole and have curvature radii less than 1000 feet) or conventional downwardly direction deviated holes (those holes which have curvature radii less than 100 feet). This has only been modestly successful since pumping systems must then be made to go down each such downward sloping branch to extract the fluid. This added complexity is not always economical nor is it an efficient method for producing the well.

U.S. Pat. No. 4.066,137 issued to Frankle, illustrates apparatus for forming a generally lateral drainhole by which oil from a target formation may be drained by which oil from a target formation may be drained to the central shaft. The flame jet apparatus must be removed and reinserted when fuel sources are depleted and in that unconventional flame or "rocket" jetting is used to form the drainhole.

IDENTIFICATION OF OBJECTS OF THE INVENTION

It is therefore a general object of the invention to be described below to overcome the disadvantages of the prior art methods and apparatus for producing multiple production wells from a central shaft for a shallow pay zone.

It is another object of the invention to produce a method and apparatus for producing deviated holes from beneath a hydrocarbon bearing formation where the deviated holes extend upwardly and outwardly from a central shaft through and extending below the hydrocarbon bearing formation.

It is another object of the invention to provide drilling equipment adapted for drilling from a vertical hole a deviated borehole starting from beneath the formation in a direction generally upwardly and outwardly.

It is another object of the invention to provide apparatus in a vertical hole in which drilling apparatus may be installed for drilling upwardly and outwardly from beneath the hydrocarbon bearing formation.

It is another object of the invention to produce a method and apparatus for drilling upwardly and outwardly into or within a formation to provide gravity assisted downward flowing drainholes that can be gathered in a central bore and then transferred to the surface.

It is still another object of the invention to produce a drilling assembly initially installed in a vertical borehole within or beneath a hydrocarbon formation which is adapted to drill upwardly and outwardly while simultaneously maintaining sufficient weight on bit for efficient boring.

It is still another object of the invention to provide apparatus for drilling a borehole using a mud pressure driven motor to turn a drilling bit and to simultaneously provide an axial drive to the drill bit of a specified force.

It is another object of the invention to provide apparatus for drilling deviated hole shafts from a central shaft which may be reversed in direction in order to remove the apparatus from the borehole.

It is another object of the invention to provide a tertiary recovery method for recovering subsurface hydrocarbons or other minerals using inverted deviated holes.

SUMMARY OF THE INVENTION

In its broadest aspect, the invention relates to a method of drilling into a target zone of a subterranean formation. The formation may be a hydrocarbon bearing formation or a formation containing other resources such as coal for example. As essentially vertical hole is provided to at least a predetermined depth below the target zone in the formation. From a point in the vertical borehole, a deviated well is drilled in essentially an upwardly and outwardly direction into the target zone. The lateral displacement of the deviated hole from the vertical hole is related to both the predetermined starting depth in the vertical borehole and the deviation rate of the drilling equipment used to drill the deviated hole.

The method further comprises drilling one or more branch holes upwardly and outwardly from the vertical bore into one or more target zones of the formation. Such branch holes may be drilled in the same plane in the earth as the first deviated hole or may be angularly spaced about the vertical hole from the first target zone. Such drilling methods enable a large portion of a formation to be economically produced by a number of shafts into a plurality of target zones, all from starting points within or beneath the formation in a single vertical hole.

According to the invention, an essentially vertical hole is first drilled adjacent to, into or through a formation. The initial vertical hole is drilled to a predetermined depth related to both the location of a laterally displaced target zone in the formation and the deviation rate of the drilling system. Casing of a relatively large diameter is placed in the vertical hole and is secured. The casing has an upwardly facing landing shoulder for landing another casing string of a smaller diameter beneath the upper part of the vertical hole.

The first casing has landing and orienting means provided at its lower end to cooperate with a carriage assembly which is lowered and oriented into the first casing. The first casing has at least one directional window provided in an upper portion of its wall and is positioned so that a drilling tool loaded in the carriage assembly may drill upwardly and outwardly through the directional window.

A length of a second casing of a second diameter smaller than the first diameter of the first casing is lowered through the interior of the first casing and is landed by means of a downwardly facing landing shoulder attached at its upper end within the first casing. Additional casing strings may be installed in the vertical hole if necessary.

Next, a carriage assembly is lowered into the vertical hole cased by means of the first casing. The carriage assembly has an upper coupling disposed at its upper end for connecting it to a working drill string extending to the surface of the vertical hole. The carriage assembly is lowered into the first casing by means of the working string. The carriage coupling has a passage through it for vertical fluid communication with the working string to the carriage assembly. The carriage assembly has a landing means at its lower end for landing the carriage assembly with respect to one of the landing and orienting keys disposed within the lower part of the first casing.

The carriage assembly has a first passage extending substantially through its entire length for communicating with the coupling and the working string. The first passage is open at the bottom of the carriage assembly. The carriage assembly has a second passage having an open upper end which is axially dimensioned within the carriage assembly such that when the carriage assembly is initially installed within the first casing, the upper end of the second passage is below the directional window in the wall of the first casing.

The lower end of the second passage is in fluid communication with the lower end of the first passage through the carriage assembly. A stripper packer assembly is disposed in the second passage above the lower open end of the first passage of the carriage assembly.

The carriage assembly has a drilling assembly disposed within the second passage as the carriage assembly is initially installed within the first casing of the vertical hole. The drilling assembly has an upwardly facing drilling motor assembly having a drilling mud driven motor and an associated drilling bit. A weight on bit assembly is connected beneath the drilling motor assembly for applying axial drilling force or axial reversing force to the drilling motor assembly. A directional drill string is connected to the weight on bit assembly below and in series with it and extends downwardly through the second passage of the carriage assembly and into the vertical shaft which is provided with the second or more casings. The stripper assembly sealingly engages the exterior of the drill string and prevents drilling fluid outside of the drill string from entering above into the second passage of the carriage assembly from the first passage.

Once the carriage assembly with its loaded drilling assembly disposed therein is positioned in the first casing, drilling mud is pumped downwardly under pressure via the working drill string and the first passage of the carriage assembly and downwardly about the exterior of the directional drill string to a point below the open end of the directional drill string, and then upwardly through the interior of the directional drill string to the weight on bit assembly and the drill motor assembly. The pressurized mud is used to drive the drilling motor assembly and the weight on bit assembly for advancing the directional drill string upwardly through the selected directional window of the first casing. The drilling motor turns the drilling bit upwardly through the earth below the target formation, while deviating the hole created by the drilling bit outwardly from the vertical hole to the target zone of the target formation. The outward deviation of the generally upward hole is accomplished by using a bent sub or the like between the drilling bit and the drilling bit mud motor.

Multiple shafts from the central vertical hole may be drilled without removing the carriage assembly from the vertical hole. In this respect, the invention further includes means for drilling multiple wells from the single initial vertical shaft. In order to drill multiple wells, a telescopic joint casing is connected to the bottom of the carriage assembly. A telescopic joint packer is also provided at the lower end of the first casing. In this embodiment of the invention, as the carriage assembly is loaded into the first casing of the well and is landed therein, the telescopic joint casing of the carriage assembly cooperates with the telescopic joint packer of the first casing. The carriage assembly telescopic joint casing functions as an internal barrel of a telescopic joint. The second casing extending below into the well acts as the outer barrel of the telescopic joint. The telescopic joint which is thereby created prevents mud pumped down the annulus of the second casing from entering the annulus between the first casing and the carriage assembly. This maintains pressurized mud flow upwardly into the directional string. The telescopic joint enables the carriage assembly to be landed at different axial or vertical positions within the first casing.

Landing of the carriage assembly at multiple axial or vertical positions within the first casing is accomplished as mentioned above by providing landing keys at various vertical and angular positions within the casing so as to cooperate with mutiple directional windows provided upwardly within the first casing.

According to the invention, a drilling assembly adapted for drilling a borehole in an earth formation is provided having a drill motor assembly with a drill bit driven by a shaft of a drill bit mud pressure driven motor and a weight-on-bit assembly coupled to the drill motor assembly. The weight-on-bit assembly includes an anti-rotation assembly for preventing rotation with respect to the borehole of the mud pressure driven motor and an axial drive assembly for applying axial force to the drill bit as it turns against the formation in the borehole.

The axial drive assembly includes an axial drive mud motor which turns a drive shaft in forward or reverse directions. The axial drive assembly also includes a gear assembly operably connected to the drive shaft of the axial drive mud motor for turning a gear assembly shaft at lower speed but higher torque than the drive shaft of the axial drive mud motor. An axial drive assembly is rotatably driven by the gear assembly shaft for engaging the borehole and imparting an axial force to the axial drive assembly and the drill bit. An hydraulic circuit is provided for controlling the direction of rotation of the drive shaft of the axial drive motor thereby operably controlling the direction of the axial force to the drill bit and providing reverse axial force to remove the drilling assembly from the hole that it has bored.

The anti-rotation assembly includes a housing connected to the drill motor assembly and a plurality of rollers mounted to the housing for rollingly contacting the walls of the borehole and for enabling the housing to move axially in the borehole while preventing rotation of the housing and the drill motor assembly connected to the anti-rotation housing.

Apparatus is provided for limiting the level of mud pressure to the axial mud pressure driven motor so as to limit the level of axial force produced by the axial drive assembly and thereby limit the amount of weight on bit of the drill bit against the borehole face of the formation.

The axial drive assembly includes a housing having a longitudinal axis and at least two rollers mounted on the housing for rotation about roller axes. Typically, each of the rollers are equally angularly spaced about the housing and are axially spaced from each other. The axes of the rollers form equal angles with respect to the longitudinal axis of the housing. The rollers are adapted to engage the borehole in a helical pattern as they move up or down with the borehole and impart an axial force to the axial drive assembly as it is turned by the gear assembly shaft.

A bent sub or the like is connected between the drill bit and the mud pressure driven motor in order to bore a deviated hole with the drilling bit.

According to another aspect of the invention, a method of recovering hydrocarbons from a subsurface earth formation beings by establishing a substantially vertical shaft hole extending from the surface of the earth to the subsurface earth formation. At least one deviated borehole in the formation is provided from the vertical shaft by boring initially in an essentially upward direction. An outer loop borehole is formed in the subsurface earth formation in proximity with the deviated borehole and communicates with the vertical shaft above the upper end and below the lower end of the deviated hole. A heating fluid such as steam is applied to the outer loop borehole by directing surface supplied steam through it while providing a return loop to the surface via the vertical shaft. The earth formation in proximity with the outer loop is heated by the steam in the outer loop borehole which facilitates drainage of oil and the like into the upwardly directed deviated hole.

BRIEF DESCRIPTION OF THE DRAWINGS

The objects, advantages and features of the invention will become more apparent by reference to the drawings which are appended hereto and wherein like numerals indicate like parts, and wherein an illustrative embodiment of the invention is shown, of which:

FIG. 1 illustrates a prior art method for drilling deviated holes downwardly and laterally into target zones of a target zone such as a hydrocarbon bearing or "pay" zone disposed a relatively shallow distance beneath the sea floor;

FIG. 2 illustrates a method of drilling according to the invention in which a vertical hole is formed through a relatively shallow pay zone to a predetermined distance beneath the pay zone and in which deviated holes are provided from beneath the pay zone in a generally upwardly and outwardly direction to one or more target zones;

FIGS. 5A, 5B, and 5C illustrate the weight-on-bit assembly according to the invention illustrating an anti-rotation assembly, an axial drive mud motor assembly, and a reversible direction axial drive assembly whereby axial force is applied to the drill bit for forcing it against the face of the borehole being drilled, while preventing rotation of the drilling motor assembly;

FIG. 8 illustrates a hydraulic circuit according to the invention whereby the direction of pressurized mud flow through the axial drive mud motor may be reversed after mud pressure to the system is stopped and then restarted again;

FIGS. 9 and 10 show details of a landing and orienting assembly disposed at the lower end of the carriage assembly for landing the carriage assembly within the first casing and for angularly orienting and landing the carriage assembly on a selected one of various landing keys disposed in the first casing;

FIG. 11 shows a cross-section through the first casing in the carriage assembly at a point above the second passage through the carriage assembly;

DESCRIPTION OF THE INVENTION

Figure 2A:
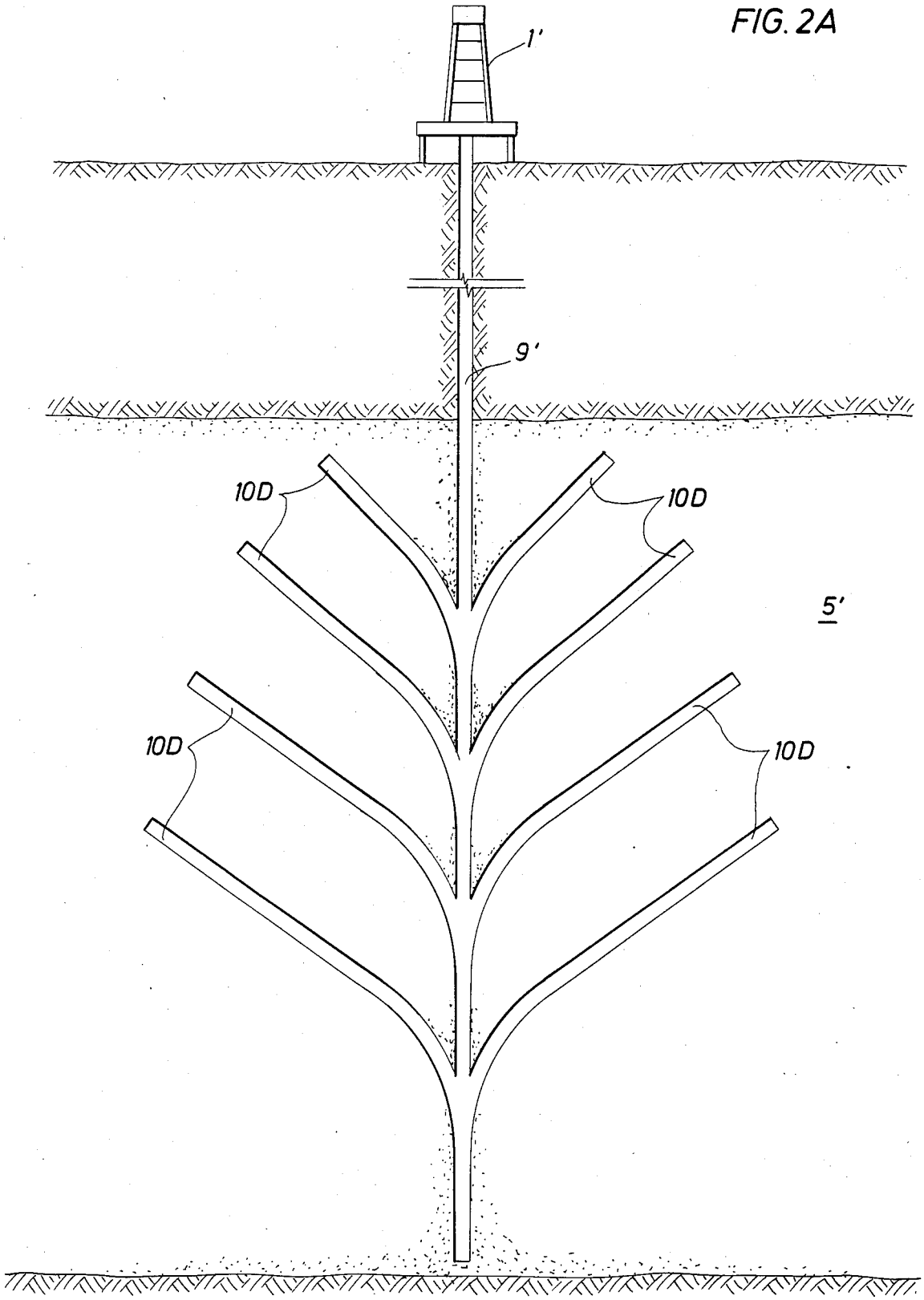
FIG. 2A illustrates a method of draining a relatively thick hydrocarbon bearing, low permeability formation whereby a plurality of essentially upwardly directed deviated holes are formed from a central vertical shaft.

FIG. 1 illustrates a prior art method for forming boreholes into a pay zone 5 disposed a relatively shallow distance beneath the floor 4 below a body of water 3. Conventionally a bottom supported drilling platform 1 is provided by which a deviated hole 7 extends to a target zone in the pay zone 5. Deviated holes are provided which fan out from a hole initially extending vertically downward and then deviating outwardly to the various target zones. Providing a number of deviated holes into the pay zone allows an expensive drilling platform to economically provide a number of wells from the single platform by which the zone may be produced efficiently. Where the pay zone is relatively shallow, say in a zone beginning at two thousand feet below the sea floor, there is not sufficient distance by which hole 7 may be laterally deviated from its vertical hole in order to economically develop the reservoir. There simply is not enough lateral distance by which the holes may extend in order to laterally reach far enough by the plurality of wells fanning out from the central vertical hole or holes. Conventional deviation drilling equipment is limited to about three degrees deviation per one hundred feet of drilling.

According to the present invention, a method of drilling of such a shallow pay zone from an offshore or other drilling rig is illustrated in FIG. 2 which allows sufficient lateral extent of the well in order that the pay zone may be economically exploited. A vertical hole 9 is first drilled from the platform or rig 1 through the pay zone 5 to a predetermined depth beneath the pay zone. With respect to the target zone illustrated as 11B for example, a predetermined minimum depth 12 beneath the formation is achieved by the vertical hole 9 with conventional drilling equipment. The depth of the hole is directly related to the deviation rate of the directional string and the location of the targeted pay zone. The well is then drilled generally upwardly and outwardly, illustrated for example by hole 10B from the starting level P beneath the pay zone 5.

In the manner illustrated by FIG. 2, the well is drilled upwardly and outwardly into the target zone 11B. The lateral distance 14 from the vertical hole 9 to the target zone 11B is related to the predetermined minimum depth 12 by the deviation rate capability of the drilling apparatus. If the apparatus can achieve a deviation rate of a certain number of degrees per one hundred feet of drilling, then the predetermined depth 12 of point P may be calculated knowing the lateral distance 14 to the target zone 11B.

For a continuously deviating upwardly and outwardly extending hole such as hole 10B of FIG. 2, a conventional bent sub may be used for the "bent sub 53" illustrated in FIG. 2. Where a hole such as hole 10A of FIG. 2, is to be provided, conventional means and methods may be employed to produce the example hole which first extends upwardly and outwardly and then extends in a substantially straight path to the target zone (e.g., 11A) in a pay zone. For example, British Patent Specification No. 1,494,273 discloses a variable angle bent sub for use in a drilling string which allows the bent angle to be varied while the sub is downhole. The sub, positioned behind the drill bit, allows selective drilling of both straight and deviated sections during a single trip into the hole. This British patent is incorporated by reference for purposes of indicating the background of the invention and for illustrating the state of the art.

Alternatively, the bent sub may be replaced by a guidance system comprising means for receiving a signal (for example through the mud column) to control the direction of a drill hole. U.S. Pat. No. 3,823,787 to Haworth et al. discloses a guidance system mounted near the drill bit for changing the direction of the bit in response to a received signal. U.S. Pat. No. 3,823,787 is incorporated by reference herewith for all purposes.

According to the method and apparatus of this invention, a plurality of wells to various target zones may all be provided from the points in the vertical hole 9 beneath the pay zone 5. For example, boreholes 10A and 10C are provided to target zones respectively 11A and 11C, as well as 11B. Such upwardly and outwardly deviated wells may be provided not only in a common plane as illustrated in FIG. 2, they may also be oriented at any angle about the vertical hole 9. Thus a plurality of wells may be drilled at any angular and/or lateral distance from or about the vertical hole 9.

The method and apparatus of this invention may also be used to form upwardly and outwardly holes within a pay zone. A zone may require that multiple holes be provided from a vertical hole to economically produce it, whether the zone is beneath land or sea. FIG. 2A illustrates a land based drilling rig 1', for example, in which a vertical hole 9' is first established. Where the zone 5' is thick, the vertical hole 9' may not extend completely through the bottom of the zone, but extends sufficiently downwardly to allow the mutiple upwardly directed deviated holes 10D extending from vertical hole 9' to provide sufficient drainage area to more economically produce the formation.

Figure 3A:
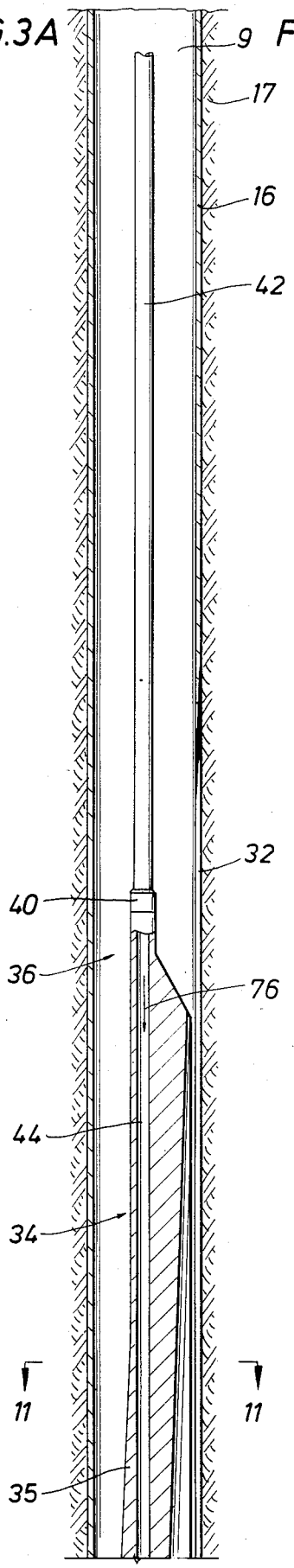
FIGS. 3A, 3B, and 3C illustrate an apparatus and method according to the invention in which first and second and/or third casings are provided in a veritcal shaft or hole through and beneath a pay zone and in which a carriage assembly is disposed within the first casing beneath a directional window in the casing and in which drilling and weight-on-bit assemblies with a downwardly extending directional drill string attached thereto is landed within a passage of the carriage assembly prior to upward and outward drilling out the directional window.
Figure 3B:
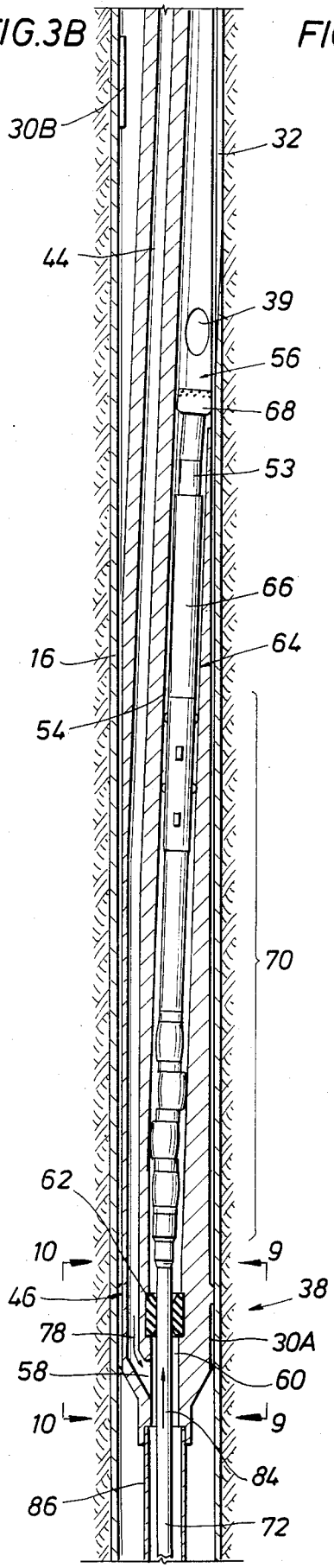
Figure 3C:
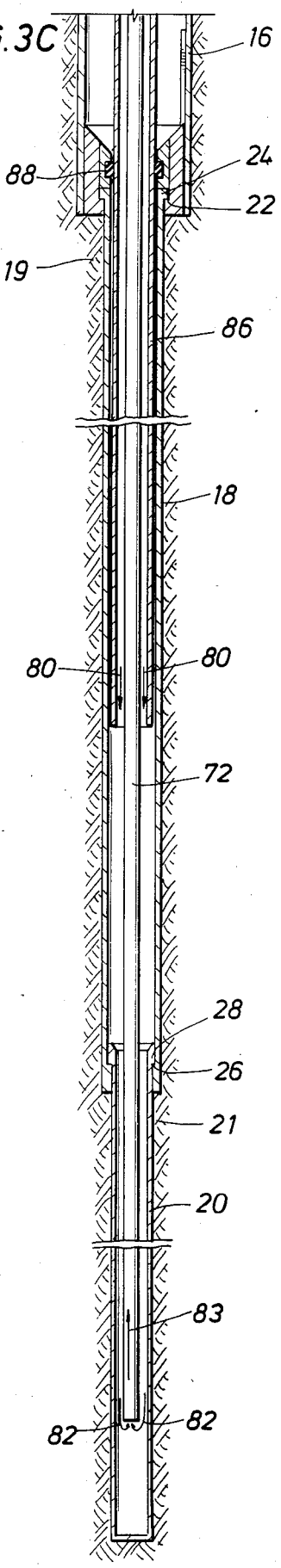

FIGS. 3A, 3B, and 3C illustrate the method and apparatus used to form upwardly and outwardly holes from beneath a pay zone. FIGS. 3A and 3B and 3C illustrate the vertical hole 9 at a point beneath the pay zone 5 of FIG. 2. For example, the FIGS. 3A, 3B, and 3C illustrate the region about a point P of FIG. 2 before the upwardly and outwardly deviated hole, for example, 10B has been started. A relatively large diameter first casing 16 is disposed in the vertical hole and is cemented in place within the formation by cement 17. A second casing 18, smaller in diameter than casing 16, is lowered and landed within an upwardly facing landing shoulder 22 fixed on the lower end of first casing 16. A downwardly facing shoulder 24 attached to the top of the second casing 18 supports it within the first casing 16 before it is cemented by cement 19 within the borehole. A third casing 20 may be provided in a similar manner. The upwardly facing shoulder 26 near the bottom of the second casing 18 supports the downwardly facing shoulder 28 on the top of the third casing 20. Cement 21 may be provided to hold the third casing 20 in place in the vertical hole.

The first casing 16 has a directional window 32 provided in its wall above an associated landing key 30A disposed in the first casing (See FIG. 3B, lower end). Landing key 30A cooperates with the landing slot 48 (see FIG. 9) of a carriage assembly disposed in the first casing. A telescopic joint packer 88 is disposed in the lower end of the first casing 16 and is illustrated at the top of FIG. 3C. The landing key 30A (as well as other landing keys such as 30B) and the telescopic joint packer 88 will be described in more detail below illustrating their cooperation with the carriage assembly 34 landed within the first casing 16.

FIGS. 3A and 3B illustrate the carriage assembly 34 after it has been landed within the first casing after having been lowered to the position illustrated by means of a working string 42 extending to the surface of the vertical hole 9. The carriage assembly has a coupling member 40 for coupling carriage housing 35 to the working string 42.

The coupling member 40 has an internal communication path for allowing fluid communication between the interior of the working string 42 and the first passage 44 extending generally longitudinally through the carriage assembly 34.

The carriage assembly 34 has a second passage 54 (see FIG. 3B) provided generally longitudinally through it. The second passage 54 has an open upper end 56 and a lower end 60 which is in fluid communication with the lower end 58 of the first passage. A stripper packer 62 is provided within the annulus of the second passage 54 near the lower end 38 of the carriage assembly.

A tubular member 86 may be secured to the lower end 38 of the carriage housing 35. After the carriage assembly 34 is landed within the first casing 16, tubular member 86 extends downwardly within the interior of the second casing 18. The telescopic joint packer 88 disposed at the lower end of the first casing 16 cooperates with the tubular member 86 to prevent fluid from passing upwardly through the annulus between the tubular member 86 and the second casing 18. In that respect, the tubular member 86 acts as the inner barrel of a telescopic joint with the second casing 18 serving as the outer barrel of the joint. The purpose of the telescopic joint 86 is to prevent pressurized drilling fluid from beneath or in the annulus between the second casing 18 and the tubular member 86 from flowing about the exterior of the carriage housing 35, while allowing the carriage housing to be landed on one or more axially separated landing keys, for example, keys 30A and 30B disposed at different axial or vertical locations within the first casing 16.

FIG. 11 illustrates the cross sectional shape of the carriage assembly 34 at the section lines 11—11 of FIG. 3A. The body of the carriage housing 35 is shown with first passage 44 extending through it. Cut out 54A is provided at an angle with the longitudinal axis of carriage assembly 35 and continues downwardly until the open upper end 56 of second passage 54 begins as seen in FIG. 3B.

A drilling assembly 64 is disposed within the second passage 54 of the carraige assembly 34. The carriage assembly 34 is lowered within the first casing 16 and is landed by means of landing and orienting assembly 46 disposed at the lower end 38 of the carriage assembly 34 on landing key 30A. The drilling assembly 64 includes a drilling motor assembly 66 and a drilling bit 68 connected to the drilling assembly 66 by means of a bent sub 53. Bent sub 53 allows the drill hole to be deviated in a known manner. The drilling assembly 64 also includes a weight-on-bit assembly 70 connected beneath the drilling motor assembly 66.

A length of directional drill string 72 is attached to the lower end of the weight-on-bit assembly 70 and extends downwardly through the stripper packer 62 within the second passage 54 of the carraige assembly 34 and extends through the tubular member 86 and downwardly into the vertical hole through the second casing 18. The carriage assembly 34 with its loaded drilling assembly 64 and the attached directional drill string 72 is all lowered and landed simultaneously within the first casing 16 with the directional drill string extending downwardly through the tubular member 86 and on down into the vertical hole.

The section lines labeled 9—9 and 10—10 of FIG. 3B correspond to FIGS. 9 and 10 illustrating the landing and orienting assembly 46 attached to the lower end 38 of the carriage assembly 34. A collar 52 has a landing slot 48 on one side and a vertical passing slot 50 disposed one hundred and eighty degrees from the landing slot 48.

As the carriage assembly is lowered into the well, the passing slot 50 enables the carriage assembly to pass an upper landing key, for example, landing key 30B at the upper end of FIG. 3B, but to land on landing key 30A within landing slot 48 of the collar 52. Thus the landing and orienting assembly 46 with its landing slot 48 on one side and its vertical passing slot 50 on the other, enables the carriage assembly 34 to be landed on various landing keys disposed angularly and vertically at different locations within the first casing 16. The vertical passing slot 50 is angularly aligned with respect to the landing key 30B as the carriage assembly 34 is being lowered within first casing 16. The directional window 32 is disposed a predetermined distance above the landing key 30A, such that when the carriage assembly is landed on the landing key 30A, the open upper end 56 of the second passage 54 is disposed a short distance beneath the directional window in the first casing 16. In a similar manner, another directional window may be disposed in the first casing 16 a like predetermined distance above the landing key 30B and of course may be disposed at a different angular location about the axis of the first casing 16 in order to direct the drilling assembly 64 toward another appropriate or a desired target zone in the pay zone above the starting location for the upward and outward drilling.

Figure 4A:
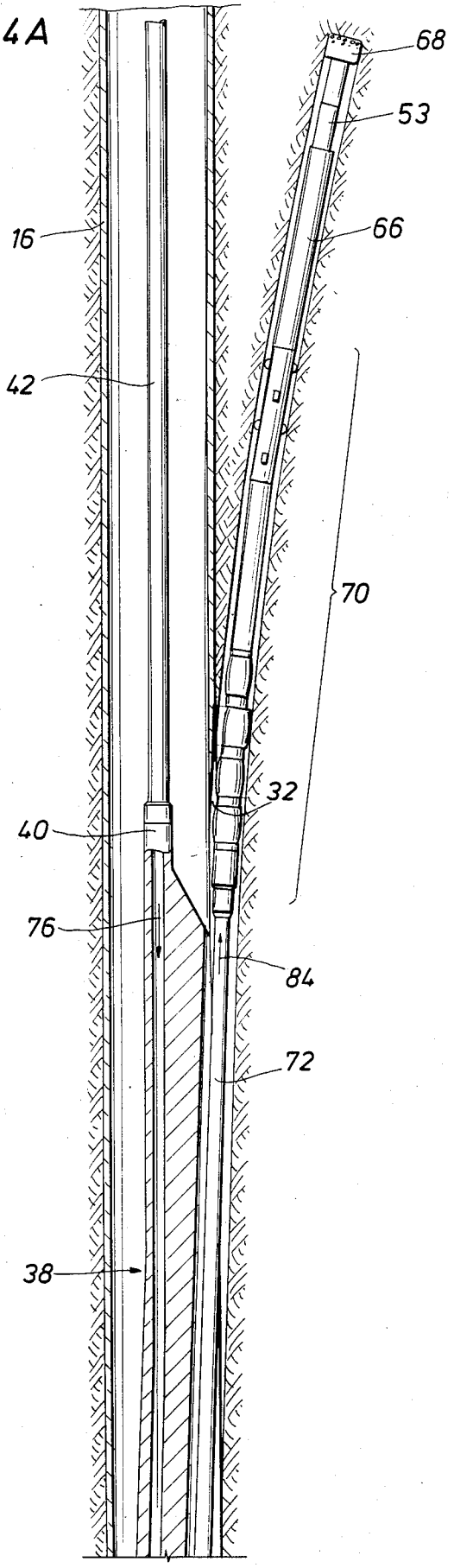
FIGS. 4A and 4B illustrate the drilling assembly as it is drilling an upward and outward deviated borehole from beneath the pay zone and after the drilling assembly and the weight-on-bit assembly have moved upwardly via the directional window of the upper casing.
Figure 4B:
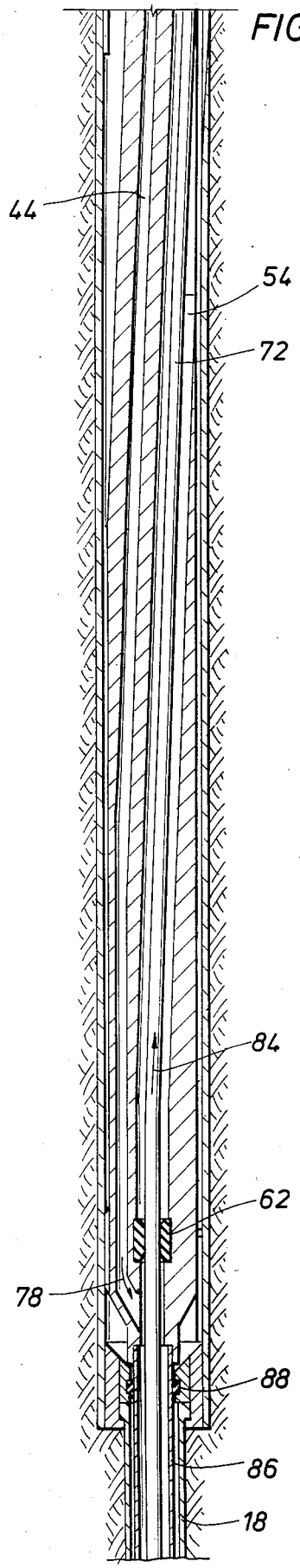

FIGS. 4A and 4B illustrate the drilling in an upward and outward direction from beneath the shallow pay zone according to the invention. As illustrated in FIG. 4A, drilling motor assembly 66 drives the drilling bit 68 for drilling an upwardly and outwardly deviated hole in cooperation with the bent sub 53. FIG. 4A shows the status of the drilling apparatus as the weight-on-bit assembly 70 is beginning to exit through the directional window 32 of the first casing 16.

FIGS. 4A and 4B in conjunction with FIGS. 3A, 3B, and 3C illustrate the direction and path of the mud flow as it is directed through the working string 42 to power the drilling motor assembly 66. The pressurized drilling fluid or "mud" extends from the drilling rig 1 through the working string 42 in a conventional manner. The mud passes through the coupling 40 and through the first passage 44 of the carriage assembly 34. The mud extends through the first passage 44 to the lower end 38 and then passes downwardly about the exterior of the directional drill string 72 connected to the bottom of the weight-on-bit assembly 70. The stripper packer 62 prevents the pressurized mud from passing upwardly about the outer annulus of the directional drill string 72 and into the interior of second passage 54 above stripper packer 62.

The mud flows downwardly through the annulus between the inner telescopic joint barrel 86 and the exterior of the directional drill string 72 and exits at the open lower end of the telescopic barrel 86, as shown in FIG. 3C by arrows 80, and flows downwardly until a point is reached as illustrated by arrows 82 near the bottom of the open end of the directional drill string 72. As the pressurized mud then passes through the interior of the directional drill string 72 as illustrated by arrow 83, it proceeds upwardly to a point as illustrated by arrow 84 near the bottom of the weight-on-bit assembly 70. The telescopic joint packer 88 prevents drilling fluid between the exterior of the telescopic joint barrel 86 and the interior of the second casing 18 from passing upwardly about the exterior of the lower end 38 of the carriage assembly 34. The pressurized mud continues through the interior of the weight-on-bit assembly 70 to provide an axial upward force to the drilling bit 68 and against the face of the formation for drilling the well and also for simultaneously driving the drilling motor assembly 66 in order to rotate the bit for the drilling.

The pressurized mud exits from the weight-on-bit assembly 70 and the drilling motor assembly 66 to the borehole being drilled and then to the carriage mud return port 39 where it is then forced upwardly about the annulus between the working string 42 and the first casing 16 to the mud return of the drilling rig.

Figure 5C:
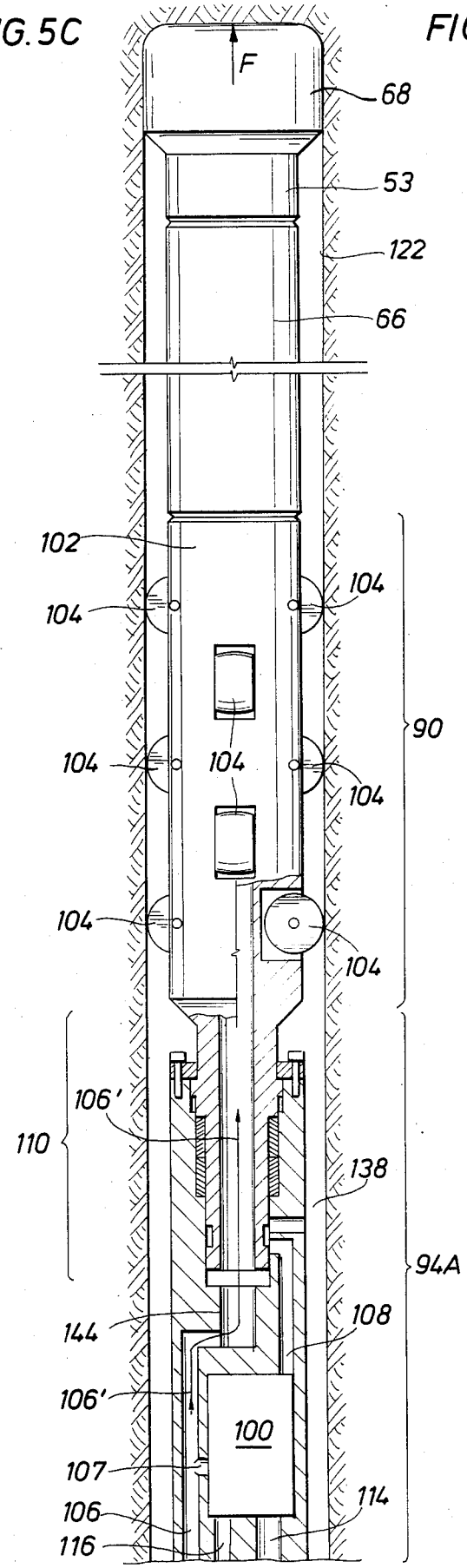

FIGS. 5A, 5B, and 5C illustrate the weight-on-bit assembly 70 of FIGS. 3B and 4A. FIG. 5C shows the upward element of the weight-on-bit assembly and is connected above the apparatus illustrated in FIG. 5B. The apparatus of FIG. 5B and 5C is connected above the apparatus of FIG. 5A. In FIG. 5C, the drilling motor assembly 66, the bent sub 53, and the drill bit 68 are schematically illustrated showing the drilling bit boring an upward and outward hole against the face of the formation. The drilling motor provided for the drilling motor assembly 66 is a conventional drilling motor which may be obtained from commercial sources. Likewise, the drill bit 68 and the bent sub 53 are commercially available apparatus and need not be described in detail here.

According to the invention, the weight-on-bit assembly 70 includes an anti-rotation assembly 90, and an axial drive mud motor assembly, the lower part of which is illustrated by reference element 94B of FIG. 5B, the upper part of which is illustrated by reference numeral 94A at the bottom of FIG. 5C. A gear assembly 96 is driven by the drive shaft 99 of the axial drive mud motor 95. The gear assembly 96 in turn drives an axial drive assembly 98, illustrated in FIG. 5A, which functions to provide upward or downwardly axial force to the drilling motor assembly and its associated drill bit 68.

The axial drive mud motor 94B illustrated in FIG. 5B is driven by mud pressure diverted from the mud pressure flow line 106. The mud enters flow line 106 from a central passage 133 running through the interior of the axial drive assembly 98 of FIG. 5A. The passage 133 communicates with the drilling string connected to the bottom of the axial drive assembly 98 by threads 141. The axial drive assembly is connected to the gear assembly 96 by means of cooperating threads 140 at the top of the axial drive assembly and threads 142 at the bottom of the gear assembly 96. The interior passage 143, of gear assembly 96, communicates with passage 133. The pressurized mud flows upwardly through passage 143 and about the conically shaped passage 146 into mud pressure flow line 106 which extends the length of the axial mud motor housing 95.

Passage 106 extends upwardly to the bottom of FIG. 5C where it communicates with passage 144 which extends upwardly through the anti-rotation assembly 90. The mud pressure drives the drilling motor assembly 66 which turns drill bit 68 via bent sub 53.

The pressurized mud from passage 106 at the bottom of FIG. 5C enters a hydraulic circuit 100 via passage 107 and is then either applied by virtue of the hydraulic circuit 100 to passage 116 or 114 which may be seen at the top of FIG. 5B. As will be explained below, the hydraulic circuit illustrated in FIG. 5C permits controlled flow of the pressurized mud in either direction, either into passage 114 and then out the passage 116 or vice versa.

The mud motor of FIG. 5B illustrates that if mud pressure flows in passage 114, the drive shaft 99 turns in one direction and the mud return flow is out the passage 116. On the other hand, if the mud flow is through 116 and exits out passage 114, the drive shaft is driven in the opposite direction. Thus, by virtue of a hydraulic circuit which may control the direction of pressurized mud flow to either passage 116 or passage 114, the direction of rotation of shaft 99 may be in either the forward or reverse direction. By virtue of the gear assembly 96, the gear assembly shaft 99' turns preferably in the same direction but at lower speed and higher torque for driving the axial drive assembly 98 either in the forward or the reverse direction in order to impart axial force to the drilling bit. The operation of the axial drive assembly 98 will be described in more detail below.

Turning now to FIG. 8, the hydraulic circuit 100 will be described. The hydraulic flow lines as well as the drilling mud motor 66 and the axial drive mud motor 95 are illustrated schematically. Pressurized mud enters through passage or line 106 and continues to the drilling mud motor 66 as indicated by flow arrow 106' in order to turn the shaft of the drilling bit. The return flow after it enters the drilling mud motor 66 is through the annulus 138 between the well tools and the borehole.

Pressurized mud enters hydraulic circuit 100 via passage or line 107. Hydraulic control circuitry is provided to apply the pressurized mud to the axial drive motor 95 in two modes. In the first mode line 107 is connected to line 114 to drive axial drive motor 95 and then exhaust the pressurized mud on line 116 and return to line 108 and back to the annulus 138 via mud pressure limiting apparatus 110. Alternatively, in the second mode, the hydraulic circuit 100 applies the pressurized mud from line 107 via line 116 to drive the axial drive mud motor 95 in the opposite direction, whereby the exhaust mud from the axial drive mud motor 95 is applied via line or passage 114 through line 108 to the mud pressure limiting apparatus 110 for return via the annulus 138.

The preferred hydraulic circuit 100 includes the three position hydraulic valve 130 and a memory valve 132. When no pressure is applied via line 107, the hydraulic valve is centered where position 130C disconnects line 107 from line 1114 and line 108 and line 116.

A memory valve 132 is provided having two positions, 132A and 132B. The memory valve 132 is cycled between positions 132A and 132B which causes valve element 130A to be between lines 107, 108, and lines 114, 116. When mud pressure approaches zero, valve element 130C is positioned to connect lines 107, 108, with lines 114, 116.

When pressure is first applied to line 107, the pressure from line 107 is directed to line 109' via line 107' to move element 130A into position between lines 107, 108, and lines 114 and 116. In that instance the flow through the axial drive mud motor 95 is in a first direction in that the flow is from line 114 through the axial drive mud motor 95, then to line 116 and back to the return line 108. Also line 114' applies pressure to a relatively large pilot area of valve 130 to maintain position 130A. Further, line 114'' shifts memory valve 132 to position 132B in preparation for the next reversing cycle. In this position, pilot pressure from line 107' is directed via line 109'' to a relatively small pilot area tending to shift valve 130 to position 130B. However, since the pilot area acted on via 109'' is relatively smaller than the pilot area acted on via 114', valve 130 stays in position 130A. When mud pressure is stopped, the memory valve 132 remains shifted such that when the pressure is reestablished in line 107', mud control flow is directed to line 109'', which moves valve element 130B into position between lines 107, 108, and lines 114, 116 reversing the flow through axial drive mud motor 95. When element 130B is in position between the lines 107, 108, and lines 114, 116, mud flow is reversed in direction whereby the pressurized mud from line 107 is applied to line 116 and the axial drive mud motor 95 exhausting via line 114 and valve element 130B to exhaust 108. Springs 131A, 131B are provided on valve 130 which cause the hydraulic valve 130C element to return to a neutral position 130C when mud pressure is not applied.

Thus, hydraulic circuit 100 is responsive to the turning on and off of the mud pressure in order to control the rotation direction of axial drive mud motor 95. To effect drilling against the face of the formation, the mud pressure continues in one direction to cause the drilling mud motor 66 to have axial force applied against the face of the formation by the drill bit. In order to reverse the apparatus from the borehole, the hydraulic circuit causes the mud flow through axial drive mud motor 95 to be directed in the opposite direction, which by virtue of the reverse turning of the drive shaft 99 of axial drive mud motor 95 (FIG. 5B), causes the axial drive assembly 98 to turn in the opposite direction.

Turning now to the description of the axial drive assembly 98 illustrated in FIG. 5A, a support member 135 is provided on which multiple rolling elements 132, 134, 136, and 137 are provided. The rolling elements are mounted with their axes extending in the general direction of the axis of the support member. However, the axis of each rolling element in displaced radially from the axis of the support member. Thus as illustrated by roller 132, its axis is displaced from the axis of support member 135 whereby contact with the borehole 122 is made at only one point about the circumference of the borehole. The other three rollers are provided in the axial drive assembly 98 at equal angles around the circumference of the support member. Roller 134 is provided having its axis provided at one hundred and eighty degrees with respect to roller 132. From the axis of roller 132, rollers 136 and 137 are provided at plus or minus ninety degree intervals from the axis of roller 132. Thus, each of the rollers 132, 134, 136, and roller 137 are contacting the borehole 122 at contact points spaced ninety degrees about the borehole. Of course, each roller contacts the borehole 122 at different axial locations along the borehole 122.

The axes of the rollers are each provided at a slight angle with respect to the axis of the borehole. When the axial drive assembly is rotated by means of the gear assembly shaft 99' of the gear assembly 96, the rollers 132, 134, 136, 137 roll about the interior of the well bore 122 in a spiral path, causing the axial drive assembly 98 to be driven axially along the well bore. Due to the small lead angle of the axis of each of the rollers, a large mechanical advantage is achieved, providing large axial force with relatively small driving torque. The driving force is applied via the axial drive mud motor assembly 94B, 94A, and the anti-rotation assembly 90 and to the drilling motor assembly 66 to the drill bit 68. When the hydraulic circuit 100 reverses the direction of mud flow to the axial drive mud motor 95, the axial force is in the opposite direction tending to drive the weight-on-bit assembly 70 and the drilling motor assembly 66 in a reverse direction so that the drilling assembly 64 may be returned to the second passage 54 of the carriage assembly 34 for removal from first casing 16 or for drilling of another upward and outward borehole.

The rollers 132, 134, 136, 137, are preferably covered with an elastomeric material to provide compliance with the rough borehole. Other means may be provided to provide resilience and apply a preload against the borehole for traction. The axial drive assembly 98, which slowly turns, in addition to providing reversible axial force to the drill bit, has the added advantage of slowly turning the drill string 72 which is attached to the drilling assembly 64 below by means of threads 141. Slowly turning the drill string 72 effectively prevents sticking of the string in the borehole as the borehole is being drilled.

The axial placement of the axial drive assembly 98 below the axial drive mud motor 95 and the gear assembly 96 below the anti-rotation assembly 90 and the drilling motor assembly 66 advantageously turns the drilling string as indicated above, and makes an additional pipe rotating assembly to prevent sticking of the pipe unnecessary for a nominal penetration rate of twenty feet per hour. The axial drive assembly 98, and thus the trailing directional drilling string 72, may be constructed to rotate at approximately five revolutions per minute. Such revolution is sufficient to prevent pipe from sticking in the trailing borehole without the need for additional pipe rotating apparatus.

Figure 6:
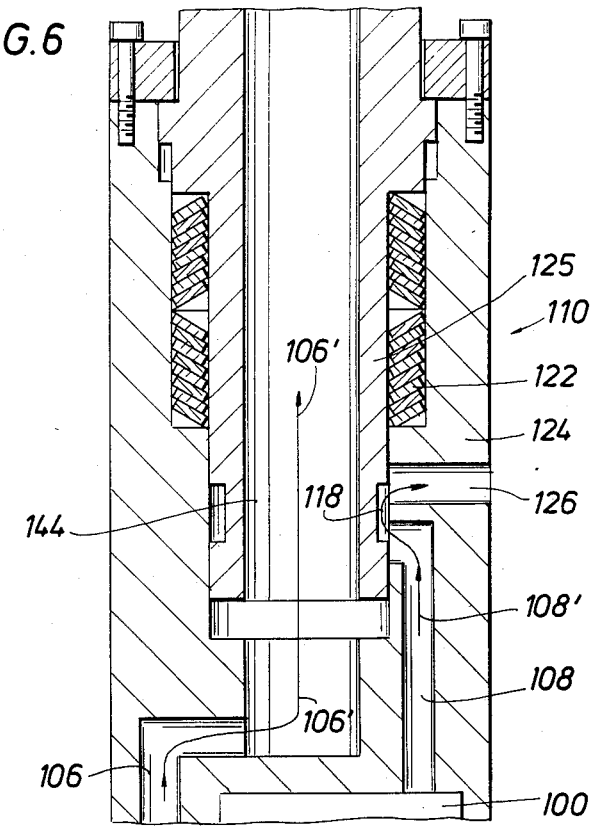
FIG. 6 illustrates a mud pressure limiting apparatus which is disposed in the upper part of the axial drive assembly, and which serves to limit the magnitude of axial force applied to the face of the drill hole of the borehole being drilled.
Figure 7:
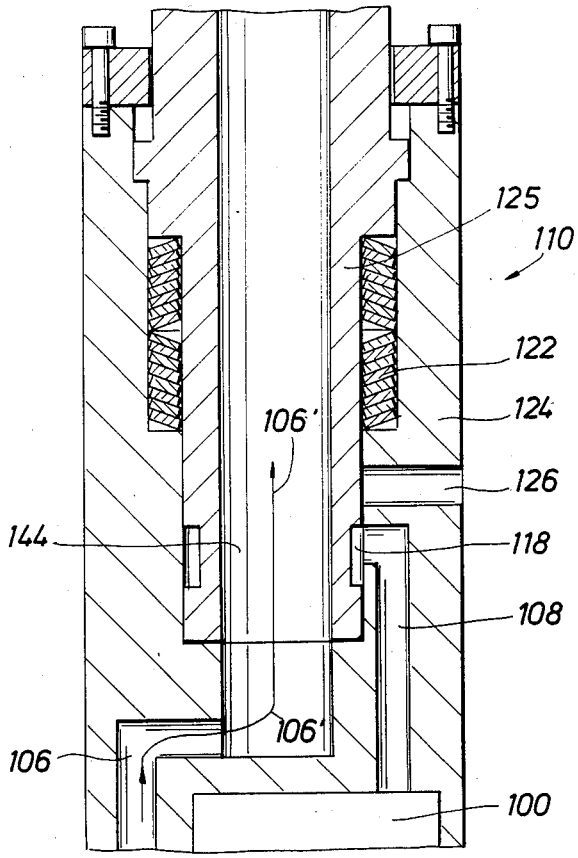
FIG. 7 illustrates the status of the mud pressure limiting apparatus when a high magnitude force has been applied to the drill bit, whereby exhaust flow from the axial drive mud motor assembly via a hydraulic circuit has been closed off thereby limiting power to the axial drive assembly.

FIGS. 5C and FIGS. 6 and 7 illustrate the placement, construction and operation of the mud pressure limiting apparatus 110. As discussed above, mud pressure from passage 106 is applied to passage 144 through the upper part of the axial drive mud motor assembly 94A and through a passage of the anti-rotation assembly 90 to the drilling assembly 66. Likewise, a passage 108 is provided from the hydraulic circuit 100 which is exhausted from the axial drive mud motor 95 as illustrated in FIGS. 5C and 6 when no axial force is applied to the drill bit 68. A sleeve 124 is positioned with respect to spool 125 such that sleeve passage 126 communicates with the spool channel 118 which is positioned to communicate with the output of exhaust passage 108. In the configuration as illustrated in FIG. 6, exhaust flow from passage 108 enters spool channel 118 and out sleeve passage 126 to provide an exhaust flow to the annulus return 138 of the borehole.

Spring 122 acts to move the spool 125 upwardly such that the spool channel 118 communicates both with the exhaust passage 108 and the sleeve passage 126. As axial force is built up in the apparatus to provide force of the drill bit 68 against the face of the formation during drilling, the axial force causes the spool 125 to overcome the opposing force of spring 122 and move spool 125 downwardly with respect to the sleeve 124 until the spool channel 118 is out of alignment with the spool passage 126. At that time the exhaust flow via passage 108 is shut off and the flow through the axial drive mud motor 95 is prevented. Flow to the axial drive mud motor 95 is prevented thereby reducing or eliminating the force applied to the drill bit. Such reduction or elimination of force to the drill bit causes the spool 125 to move upwardly in response to the spring 122, thus realigning the spool channel 118 with the sleeve passage 126, reestablishing the flow, and again causing the axial drive mud motor 95 to impart upward axial force against the borehole. In the reverse direction, of course, the spring 122 maintains the spool 125 upwardly as in FIG. 6 providing an exhaust flow from passage 108 to spool channel 118 to sleeve passage 126 insuring that the apparatus may be caused to rotate out of the borehole.

Turning now to FIG. 5C again, the axial rotation assembly 90 is provided having a housing 102 and rollers 104 provided along the axis of the housing and about the periphery thereof. The rollers are mounted having their axes at ninety degrees of that of the axis of the housing such that the rollers are free to roll parallel to the axis of the borehole and yet prevent rotation of the housing 102 about the axis of the housing. The anti-rotation assembly 90 provides a stable platform from which the drilling motor assembly 66 may cause the drill bit 68 to turn against the face of the borehole. Preferably the rollers 104 are coated with an elastomeric material to provide compliance with the rough borehole. Alternatively, the rollers may be of steel and resiliently mounted in the housing. The anti-rotation assembly also reacts against torque imposed on the assembly from the axial drive assembly.

METHOD AND OPERATION

Having described the apparatus in detail above, it is instructive to describe how a well may be drilled to a target zone of a hydrocarbon bearing formation from a vertical shaft provided through the hydrocarbon bearing formation. As illustrated in FIGS. 3A, 3B, and 3C, a vertical hole is illustrated below the hydrocarbon formation. The well first has a relatively large diameter which is cased and cemented by means of a first casing 16. One or more casings may be provided below the first casing. For example, second casing 18 may be landed within the upwardly facing landing shoulder of the first casing 16 by means of a downwardly landing shoulder on the second casing 18. Similarly, a third casing 20 may be provided below the second casing 18.

Next, a carriage assembly loaded with a drilling assembly 64 and a trailing directional drill string 72 is lowered into the first casing 16 by means of a working string 42. The carriage assembly is angularly and axially oriented by means of a landing and orienting assembly 46 disposed at the lower end 38 of the carriage assembly 34. The landing and orienting assembly 46 cooperates with a landing key 30A which is disposed in the interior of the first casing 16 which is provided a predetermined distance below a directional window 32 within the first casing 16.

After the carriage assembly has been so landed with its drilling assembly 64 and directional drill string 72 loaded therein, the drilling upwardly and outwardly is started by providing pressurized mud via the working string 42 and up the directional drill string 72. As described previously, the pressurized mud extends down through a first passage 44 of the carriage assembly and about the annulus between the inner barrel 86 of an effective telescopic joint and the drill string 72 and downwardly until the mud pressure enters the bottom of the directional drill string 72 and extends upwardly into the interior of the drilling assembly 64 disposed in a second passage 54 of the carriage assembly 34. Mud pumps are started at the surface causing the drilling assembly 64 to crawl upwardly by virtue of an axial drive assembly 98 as illustrated in FIG. 5A. The direction of motion of drilling assembly is controlled by means of hydraulic circuit 100 applying mud pressure in one of two directions through an axial drive mud motor 95 illustrated in FIG. 5B.

The drilling assembly 64 moves upwardly out the directional window 32 and by virtue of the axial force imparted by the axial drive assembly 98 drills an upwardly and outwardly deviated hole in the formation by means of a mud motor 66 driving a drill bit 68 by means of a bent sub 53.

After the well has been drilled to its target zone, or if trouble should result, the drilling motor assembly 66 may be reversed by stopping the mud pumps and restarting them which changes the direction of the turning of the axial drive assembly 98 and reverses the direction of motion of the drilling apparatus. After the drilling apparatus has been returned to its original position within the first casing 16 the carriage assembly may be moved upwardly such that the passing slot 50 of the landing and orienting assembly 46 attached to the lower end 38 of the carriage assembly 34 passes the landing key of 30B. By rotating the carriage assembly one hundred and eighty degrees, the landing slot 48 may come into angular alignment with the landing key of 30B, whereby lowering of the carraige assembly 34 causes the landing slot 48 to land on landing key 30B. In that instance a new well may be provided out of an upper directional window (not illustrated) and drilling started as described above.

TERTIARY RECOVERY USING INVERTED DEVIATED HOLES

Figure 12:
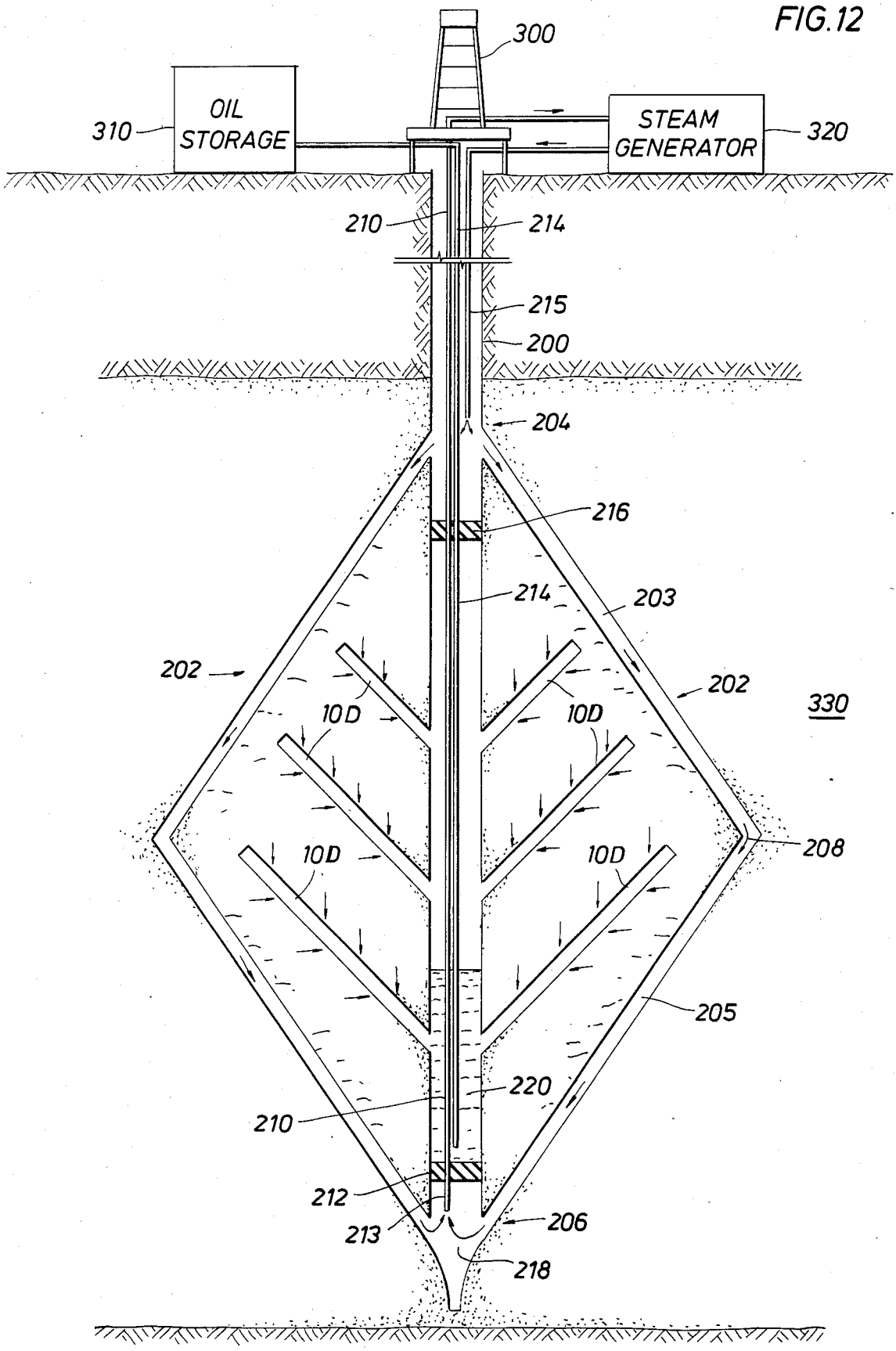
FIG. 12 shows a tertiary method of recovering hydrocarbons from inverted holes extending from a vertical shaft by applying heating fluid in a loop including an outer borehole and the vertical shaft.

According to another aspect of the invention, the ability to produce of the upwardly deviated boreholes in a tight formation may be enhanced by heating the formation to reduce the viscosity of the hydrocarbons in the formation. FIG. 12 illustrates a well in which multiple upwardly deviated holes 10D have been formed from a central shaft 200. One or more outer loop boreholes 202 are formed from central shaft 200 to extend outwardly about and in proximity with the upwardly deviated holes 10D. Each outer loop 202 may be provided to come inside or outside of the upwardly deviated holes 10D considering that the upwardly deviated holes may not be coplanar. As shown in FIG. 12, the outer loop boreholes appear to envelope the upwardly deviated holes 10D, but one or more of the holes 10D may extend outwardly more than outer borehole loop 202 if the outer loop borehole 202 is in a different plane from the holes 10D.

Each outer loop borehole 202 may be formed by conventional deviated hole forming techniques by downwardly deviating leg 203 of outer borehole 202 and then changing the angle of deviation to continuously form leg 205 until it intersects vertical shaft 200 at lower point 206 below the downward intersections of vertical shaft 200 and upwardly deviated holes 10D. Alternatively, the downward leg 203 may first be formed by conventional deviated well forming techniques followed by forming leg 205 according to the upwardly deviated hole forming techniques disclosed above in this specification. Leg 205 is formed upwardly and outwardly until it intersects downward leg 203 at point 208 thereby forming outer borehole loop 202. Of course, leg 205 could be formed first and intersected by leg 203.

Having formed outer borehole loop 202 about one or more upwardly deviated holes 10D, a path is formed for applying a heating fluid such as superheated stean to the outer loop 202 with a return path to the surface along the vertical shaft from which the upwardly deviated holes 10D extend. The heat from the heating fluid heats the hydrocarbon bearing formation lowering the viscosity of the hydrocarbons of the formation which facilitates drainage of the hydrocarbons into the holes 10D for collecting in the effective bottom of the vertical shaft for their production, as by pumping, to the surface.

FIG. 12 shows production hardware including rig 300 which may be used to facilitate the heating and producing of the formation. A heating fluid return tube 210 with an attached lower packer 212 is lowered into vertical shaft 200 simultaneously with well fluid return tube 214. An upper packer 216 is attached to both heating fluid tubing 210 and to well fluid return tube 214. The lower packer 212 and upper packer 216 are spaced apart a predetermined distance such that lower packer 212 is above the lowest end 218 of the intersection of the outer loop 202 with the vertical shaft 200. A short section 213 of heating fluid return tubing 210 extends below packer 212 to provide a return path for heating fluid to the surface. The well fluid return tube 214 extends to the bottom of vertical shaft 200 but above packer 212 to provide a return path for hydrocarbons 220 which drain the the bottom of vertical shaft 200 above packer 212. Well fluid return tube 214 communicates with oil storage facility 310.

Heating fluid tubing 215 is lowered into the vertical shaft 200 until its lower end is in proximity with the upper end 204 of outer loop borehole 202. The upper ends of tubing 215 and of tubing 210 communicate with a surface disposed source of heating fluid 320.

In operation, the system of FIG. 12 is adapted for application of heating fluid such as steam through heating fluid tubing 215. The heating fluid enters the upper end 204 of outer loop borehole 202 but is prevented from vertical movement downwardly into the vertical shaft by means of upper packer 216. As the heating fluid moves downwardly through one or more outer boreholes 202, it heats the formation so as to lower the viscosity of hydrocarbons in formation 330 thereby facilitating drainage of oil and the like via upwardly deviated boreholes 10D. Collected oil 220 drains into the bottom of vertical shaft 200 above lower packer 212. Heating fluid returns to heating fluid source 320 via heating fluid return tubing 210. The drained oil and the like collected at 220 is produced to storage facility 310 via well fluid return tubing 214. The direction of flow can be reversed to move vertically to the bottom of the hole, then outward and upward through multiple outer loop boreholes 202 if so desired.

Figure 13:
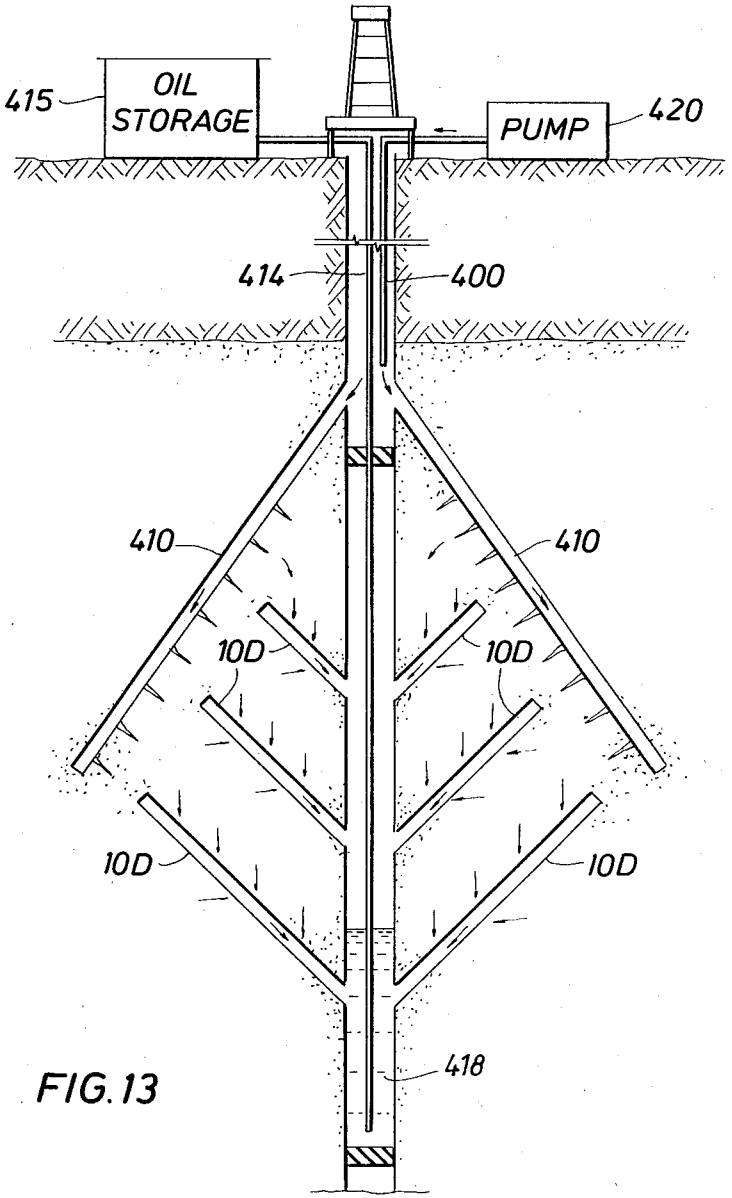
FIG. 13 shows a tertiary method of recovering hydrocarbons by applying recovery enhancing fluids in the vicinity of an inverted hole extending from a vertical shaft.

FIG. 13 shows an enhanced hydrocarbon recovery arrangement using upwardly deviated holes 10D from a vertical shaft 400 in which deviated outer boreholes 410 are formed in proximity with the holes 10D. A pump 420 applies recovery enhancing fluids such as water or chemicals into the formation in the vicinity of the holes 10D. Hydrocarbon in the sedimentary rock adjacent holes 10D is forced toward the drainholes 10D and drains to the bottom 418 of the hole from which it is pumped via return pipe 414 to oil storage tank 415.

Figure 14:
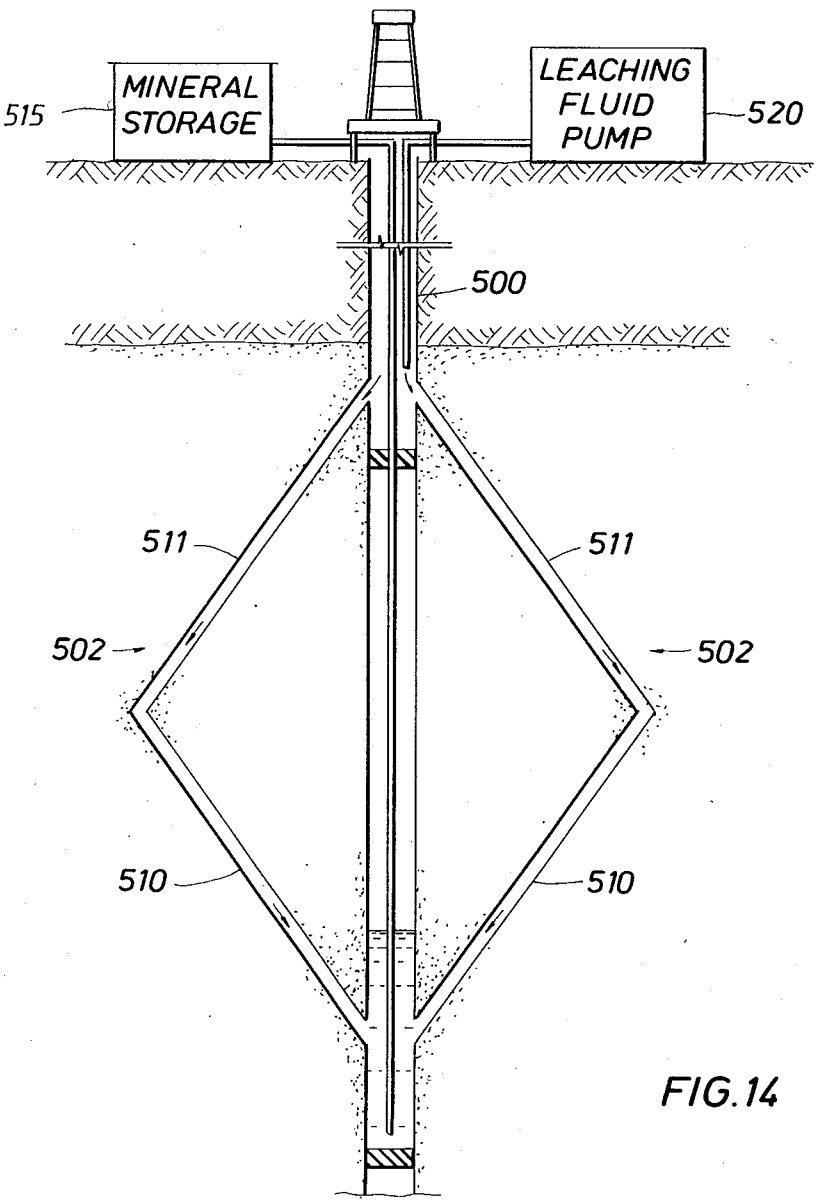
FIG. 14 shows a method for leaching minerals from a mineral bearing earth formation having a loop extending through it, one part of which is formed as an inverted hole extending from a vertical shaft.

FIG. 14 illustrates the use of one or more outer loop boreholes which may be used to leach minerals, e.g., sulphur, from the encompassed volume of earth. Loops 502 are created by forming upwardly deviated holes 510 by the methods according to this invention and by forming downwardly deviated holes 511 by conventional means. The ends of holes 510 intersect with corresponding ends of holes 511 thereby creating outer loops 502. A leaching liquid for example, hot water, is pumped through the formation via the loops 502. The leached mineral in solution with the leaching liquid collects in the bottom of the vertical shaft 500 from which it may be pumped to mineral storage tank 515 where the mineral and the leaching fluid may be separated.

Various modifications and alterations in the described method will be apparent to those skilled in the art of the foregoing description which does not depart from the spirit of the invention. For this reason, these changes are desired to be included in the appended claims. The appended claims recite the only limitations of the present invention and the descriptive manner which is employed for setting forth the embodiments and is to be interpreted as illustrative and not limitative.

What is claimed is:

1. A method of recovering oil and the like from a subsurface earth formation comprising the steps of:

establishing a substantially vertical shaft hole extending from the surface of the earth to said subsurface earth formation, boring from said vertical shaft intially in an essentially upward direction in the formation at least one deviated hole in the formation, said deviated hole having an upper end and communicating at its lower end with said vertical shaft, forming an outer loop borehole in said subsurface earth formation and in proximity with said deviated hole, said outer loop borehole communicating with said vertical shaft above the upper end and below the lower end of said deviated hole, injecting a heating fluid from the surface to said outer loop borehole and directing said heating fluid in a loop comprising the outer loop borehole and the portion of the vertical shaft between the top and bottom of said outer loop borehole with the return of said heating fluid to the surface via said vertical shaft, whereby the earth formation in proximity with said outer loop borehole is heated thereby facilitating drainage of oil and the like into said upwardly directed deviated hole.

2. The method of claim 1 further comprising the steps of:

attaching a first packer to the lower end of a heating fluid return tubing, attaching a second packer to a well fluid return tubing and to said heating fluid return tubing, installing said first packer and said heating fluid return tubing and said second packer and said well fluid return tubing in said vertical shaft and activating said first packer to pack off said vertical shaft below the lower end of said deviated hole, said heating fluid return tubing extending below said activated first packer, said well fluid return tubing extending above said activated first packer, activating said second packer to pack off said vertical shaft below the intersection of the upper end of said outer loop borehole and said vertical shaft and above the lower end of said deviated hole, and installing a heating fluid tubing in said vertical shaft, the lower end of said heating fluid tubing extending to the vicinity of the intersection of the upper end of said outer loop borehole and said vertical shaft, operably facilitating the injection of said heating fluid from the surface via said heating fluid tubing, said heating fluid flowing about said outer loop borehole and returning to the surface via said heating fluid return tubing.

3. The method of claim 2 wherein said heating fluid is applied from a surface disposed source of heating fluid to said heating fluid tubing for application to the upper end of said outer loop borehole and wherein said heating fluid returns to the surface via said heating fluid return tubing.

4. The method of claim 1 wherein said outer loop borehole is formed by the substeps of forming from a lower position in said vertical shaft in an essentially upward direction in the formation an upwardly directed deviated hole having an outer upper end, and forming from an upper position in said vertical shaft in an essentially downward direction in the formation a downwardly directed deviated hole having an outer lower end, wherein said outer upper end of said upwardly directed deviated hole intersects the outer lower end of said downwardly directed deviated hole providing fluid communication through said outer loop borehole from the lower position of said vertical shaft to the upper position of said vertical shaft.

5. The method of claim 1 wherein a plurality of upwardly directed deviated holes are formed from said vertical shaft and a plurality of outer loop boreholes are formed about and in proximity with said plurality of upwardly directed deviated holes.

6. The method of claim 1 wherein said heating fluid is steam.

7. A method of recovering oil and the like from a subsurface earth formation comprising the steps of:

establishing a substantially vertical shaft hole extending from the surface of the earth to said subsurface earth formation, boring from said vertical shaft initially in an essentially upward direction in the formation at least one deviated hole in the formation, said deviated hole having an upper end and communicating at its lower end with said vertical shaft, forming from an upper end in said vertical shaft in an essentially downward direction an outer borehole in said subsurface earth formation in proximity with said deviated hole, said outer borehole communicating with said vertical shaft and horizontally overlapping said deviated hole, and directing recovery enhancing fluids from the surface through the upper end of said vertical shaft to said outer borehole and injecting said fluids into the formation in proximity with said deviated hole whereby said fluids injected into the earth formation in proximity with said hole facilitates drainage of oil and the like into said upwardly directed deviated hole.

* * * * *